US005090805A

United States Patent [19]

Stawarz

[11] Patent Number: 5,090,805

[45] Date of Patent: Feb. 25, 1992

[54] BOW SIGHT WITH PROJECTED RETICLE AIMING SPOT

[75] Inventor: Dick A. Stawarz, Onalaska, Wis.

[73] Assignee: Blount, Inc., Montgomery, Ala.

[21] Appl. No.: 567,923

[22] Filed: Aug. 15, 1990

[51] Int. Cl.[5] ..... G02D 23/10

[52] U.S. Cl. ..... 356/251; 33/241; 33/265; 356/252; 124/87; 42/100

[58] Field of Search ..... 356/251, 252; 33/241-243, 251, 265; 124/87; 42/100

[56] References Cited

U.S. PATENT DOCUMENTS

| | | | |
|---|---|---|---|
| 3,645,635 | 2/1972 | Steck | 356/252 |
| 3,700,339 | 10/1972 | Steck | 356/247 |
| 3,813,790 | 6/1974 | Kaltmann | 356/252 |
| 3,897,158 | 7/1975 | Steck | 356/251 |
| 3,991,500 | 11/1976 | Kershner et al. | 42/100 |
| 3,994,597 | 11/1976 | Calder et al. | 356/252 |

*Primary Examiner*—F. L. Evans

*Attorney, Agent, or Firm*—Klarquist, Sparkman, Campbell, Leigh & Whinston

[57] ABSTRACT

A bow sight apparatus is described with at least one lighted reticle aiming spot which is projected onto a partially reflecting mirror through which the target is viewed to superimpose the aiming spot on the target image. A light guide of fluorescent plastic is employed to convert ambient visible light entering such light guide into colored light of a selected wavelength, such as green light, which is transmitted through one or more aiming apertures in a reticle member to produce the aiming spot. Range adjustment is provided by moving a reticle projection mirror to adjust the position of the aiming spot between different precalibrated range positions, or by providing several different aiming spots corresponding to different target ranges. A bow mount attaches the sight to a bow handle by a bracket which adjusts the sight vertically and horizontally for calibration sighting of the sight. A battery operated auxiliary light, such as a switch actuated light emitting diode, may be mounted on the light guide to direct additional colored light into it.

18 Claims, 6 Drawing Sheets

55
24
58
62
22
53
52
54
62
56
10
7
4
44
48
42
32
20
21
50
28
24
90
6
5
22
7
62
6
52
46
82
76
40
74
34
36
38
55
18
16
57
12
14
16
18
59
96
30
29
26
88
90
68
98
5

BOW SIGHT WITH PROJECTED RETICLE AIMING SPOT

BACKGROUND OF INVENTION

The subject matter of the present invention relates generally to optical sighting apparatus for weapons such as hunting bows, and in particular, to a bow sight for viewing a target through a partial reflective mirror onto which is projected the image of a lighted reticle located outside the field of view of such target to provide an aiming spot of colored light superimposed over the image of the target. A light guide member transmits colored light through at least one aiming aperture in the reticle to provide the aiming spot. The bow sight apparatus of the present invention is especially useful for hunting bows used to shoot wild game with arrows, but may also be employed for stationary target shooting.

It has previously been proposed in U.S. Pat. No. 3,645,635 of Steck issued Feb. 29, 1977 and U.S. Pat. No. 3,897,158 of Steck issued July 29, 1975 to provide a sighting device for a firearm such as a shotgun employing a lighted reticle of fluorescent plastic material positioned outside the field of view of the sighting device for superimposing a lighted aiming spot over the image of the target viewed by such sighting device. The image of the reticle aiming spot is projected onto a partial reflecting mirror through which the image of the target is transmitted in order to superimpose such aiming spot on the image of the target. However, unlike the bow sight apparatus of the present invention, the lighted reticle aiming spot of such prior patents is formed by the entire output end of the fluorescent plastic member, such reticle member converting ambient light into fluorescent light of a different color such as red or orange. This limited the diameter or thickness of the reticle rod or plate to a range of 0.020 to 0.150 inch or less which reduced the lighting efficiency and necessitated increasing the side area of the reticle by providing a spiral shaped rod or a flat plate with a ball and socket corner connection. This problem is avoided in the present bow sight by employing a light guide whose output end overlaps one or more aiming apertures in the reticle member so that such light guide is of a larger cross sectional area than the aiming spots produced by such apertures and has greater lighting efficiency. In addition such prior sighting device includes internal windage and elevation adjustments but no adjustments for different target ranges or the use of multiple of aiming spots for different ranges in the manner of the present invention. In addition, the bow sight of the present invention employs an adjustable bow mount means for mounting the sight on a bow and for adjusting the bow sight vertically and horizontally to aim the bow which of course is not shown in such prior patents. The bow sight of the present invention is also more versatile in that it employs a range adjustment feature which moves the position of a single aiming spot on the target image to provide different ranges.

U.S. Pat. No. 3,700,339 of Steck issued Oct. 24, 1972 is also of interest as showing a gun sight for a firearm employing a fluorescent reticle mounted directly in the field of view of the target at the end of the barrel of a pistol or rifle. Such gun sight is not practical for a bow sight because the aiming reticle must be positioned several feet from the eye so as to obscure very little of the target image.

The bow sight apparatus of the present invention has several advantages including a lighted aiming spot of small size and high brightness for maximum visibility superimposed over the target image without obstructing the view of the target. In addition, the bow sight is more versatile in that it is provided with adjustable target range selection. In one embodiment a range adjustment from 20 to 40 yards is achieved by moving a single aiming spot. In another embodiment range adjustment is achieved with 3 different ranges provided by employing 3 spaced aiming spots which are distinguishable from one another, such as by their size or vertical position for dots of the same size.

The present bow sight has the added advantage of providing an extremely accurate sight by employing a bow mounting bracket which is adjustable vertically and horizontally in order to more accurately set the aiming spot on the point of impact of the arrow during calibration aiming in of the sight. With the present invention using a separate target viewer and a projected light reticle positioned outside the field of view of such viewer, a much wider field of view and sharp image focus are achieved. This also enables fast handling of the bow in the field for more productive hunting. Another advantage of the bow sight of the present invention is that a battery operated light source such as a light emitting diode (LED), may be employed to further increase the brightness of the aiming spot which may be desireable under low ambient light conditions. The LED light source and the fluorescent plastic material of the light guide may be selected to produce an aiming spot of the same green color light wavelength which is more easily reflected by the partial reflecting beam splitting mirror. In addition, such beam splitting mirror is mounted more accurately by slotted plastic mounting buttons on opposite sides thereof and to resist damage by means of resilient shock absorbing rubber mounting pads at the top and bottom of such mirror to prevent misalignment or breakage to the mirror during use.

SUMMARY OF INVENTION

It is therefore one object of the present invention to provide an improved bow sight of simple and reliable operation including a lighted reticle located outside the field of view to provide an aiming spot of high brightness which is projected onto and superimposed over the image of the target in such field of view but which does not obscure the target.

Another object of the invention is to provide such a bow sight apparatus in which the aiming spot is provided by a light guide member for transmitting visible light of a selected color through at least one aiming aperture in the reticle to produce such aiming spot, such light guide member having a light output end in which is larger than the aiming aperture and being more efficient in light transmission to produce an aiming spot of high brightness.

A further object of the invention is to provide such a bow sight apparatus of greater accuracy and versatility which has a plurality of different target ranges and means for adjusting the bow sight to select the desired range.

An additional object of the invention is to provide such bow sight apparatus in which the range adjustment is accomplished by moving an optical element in order to change the position of the aiming spot superimposed over the target in the field of view.

Still another object of the present invention is to provide a bow sight apparatus in which a plurality of aiming spots distinguishable from each other are provided corresponding to different target ranges by a plurality of aiming apertures in the reticle which are illuminated by a common light guide member whose output end covers all of such aiming apertures.

A further object of the present invention is to provide such a bow sight apparatus employing an adjustable bow mount means which is adjustable, both vertically and horizontally to aim the bow sight so that the aiming spot designates the point of impact of the arrow more accurately.

A still further object of the invention is to provide such a bow sight including a battery operated auxiliary light source for illuminating the light guide to provide an aiming spot of greater brightness.

A still additional object of the invention is to provide such a bow sight in which the light source is a light emitting diode which produces light of selected color wavelength in an efficient manner and to provide an aiming spot of the desired brightness and color for maximum visibility.

DESCRIPTION OF DRAWINGS

Other objects and advantages of the present invention will be apparent from the following detailed description of certain preferred embodiments thereof, and from the attached drawings of which.

DESCRIPTION OF PREFERRED EMBODIMENTS

Figure 1:
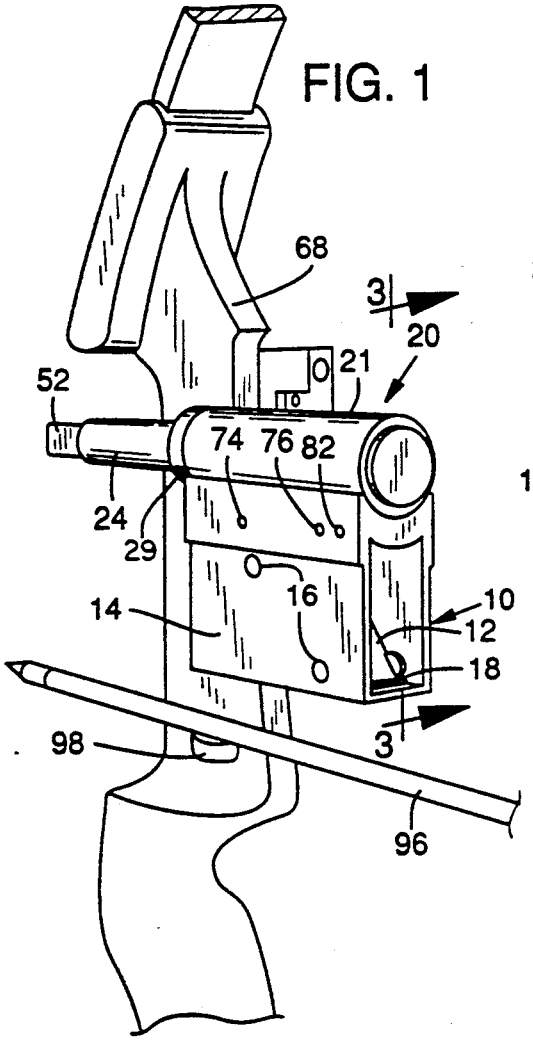
FIG. 1 is an oblique rear elevation view of one embodiment of the bow sight apparatus of the present invention mounted on a bow with unrelated bow parts broken away.
Figure 2:
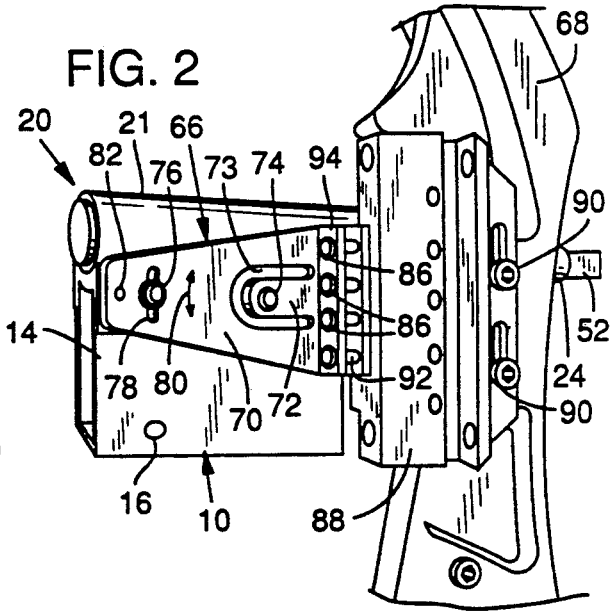
FIG. 2 is a side elevation view of the bow sight apparatus of FIG. 1 showing the bow mount.
Figures 3, 6:
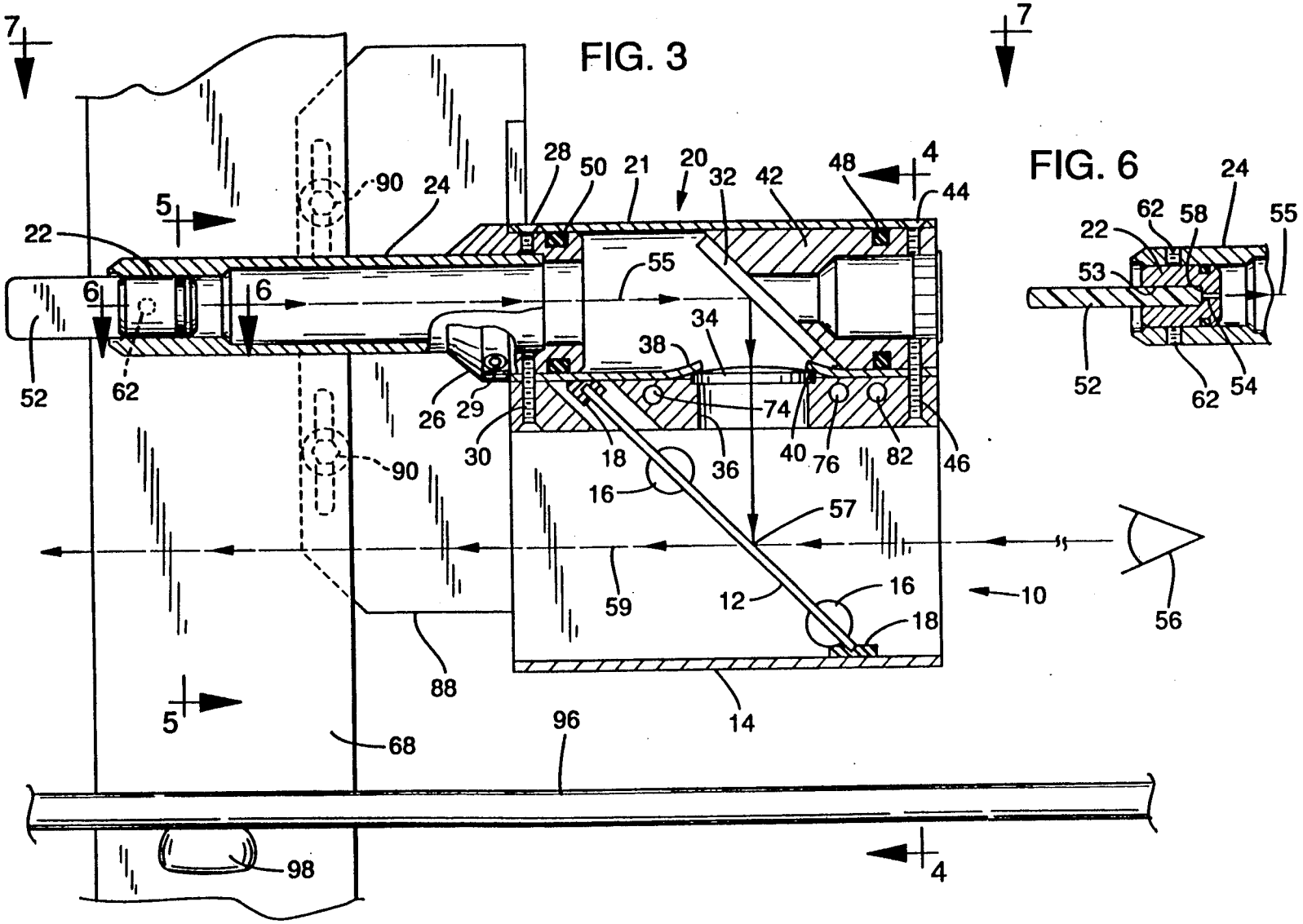
FIG. 3 is an enlarged vertical section view taken along the line 3—3 of FIG. 1.
FIG. 6 is an enlarged horizontal section view taken along the line 6—6 of FIG. 3.

As shown in FIGS. 1, 2 and 3, one embodiment of the bow sight apparatus of the present invention includes an optical viewer 10 comprising a partial reflecting mirror 12, sometimes referred to as a "beam splitter" mirror, which has a dichroic reflective coating for reflecting light of a selected wavelength such as that of green visible light while transmitting a high percentage of all other wavelengths of visible light. The mirror is mounted within a metal rectangular bottom housing 14, between two pairs of slotted plastic buttons 16, which extend through the sides of the metal housing. Each pair of mounting buttons have interior surface slots which are aligned to receive the side edges of the mirror. The bottom and top edges of the mirror are resiliently shock mounted on mounting pads 18 of rubber or other elastomer material. A projected reticle optical system 20, is mounted within a cylindrical top housing 21 at a position above the viewer 10. The projected reticle system includes a reticle member 22 releasably mounted within a cylindrical metal extension sleeve 24 which is secured to the housing 21 by means of a front end adaptor member 26 that is fastened by screws 28, 29, and 30 to the sleeve and such housing. In addition, a conventional totally reflecting mirror 32 is supported within the housing 21 with its center aligned with the axis of a lens 34 extending across an opening 36 communicating into the viewer 10, such lens being held in position by leaf springs 38 and 40. The mirror 32 is mounted within the housing 21 on a support member 42 which is secured to the housing 21 by means of screws 44 and 46. The bottom screws 30 and 46 also secure the cylindrical top housing 21 to the rectangular bottom housing. Two rubber o-ring light seals 48 and 50 may be provided between the mirror mount 42 and housing 21 and between adaptor 26 and such housing.

Figure 5:
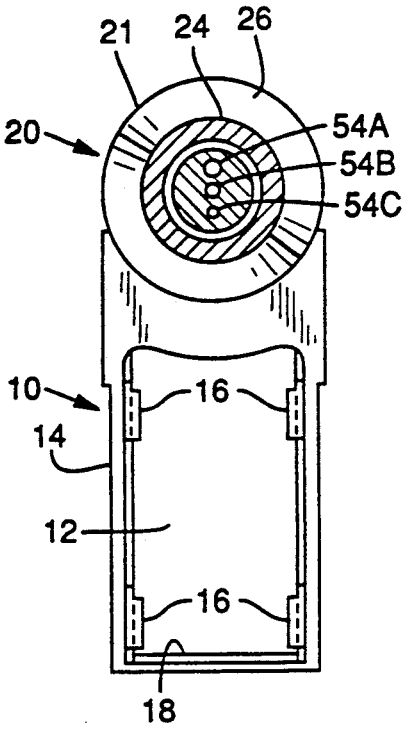
FIG. 5 is a vertical section view taken along the line 5—5 of FIG. 3.

A light guide 52 of fluorescent plastic material which may be a flat rectangular plate is mounted within the sleeve 24 in a rectangular slot 53 provided in the reticle member 22 as shown in FIG. 6. The fluorescent plastic material may be made of acrylic polymer containing a dye additive which causes it to emit fluorescent light of a selected bright visible color such as green wavelength visible light having a wavelength of approximately 535 nanometers. Thus, when ambient white visible light enters the exposed end of the light guide 52 it is converted to green light which is transmitted through one or more aiming apertures 54 in the reticle member 22 to provide aiming spots which are transmitted along a light path 55 and reflected from the mirror 32 downward through the lens 34. The aiming spots are projected onto the surface of the partially reflecting mirror 12 at a position 57 superimposed over the target image viewed by the observer 56 along light path 59 through such mirror. As shown in FIGS. 5 and 6, in one embodiment of the bow sight of the present invention, the reticle member 22 may be provided with three spaced aiming apertures 54A, 54B, and 54C through which light is transmitted along the light path 55 from the output end 58 of the light guide 52 to produce three vertically spaced aiming spots 60 A, 60 B and 60 C as shown in FIG. 4, projected onto the partial reflecting mirror 12.

As shown in FIG. 6, the reticle member 22 may be secured within the sleeve 24 by a pair of set screws 62 which extend through threaded holes in the sleeve into engagement with the opposite sides of the reticle member. Alternatively it is possible to provide the external surface of the reticle member 22 with threads which engage threads on the interior of the sleeve 24 for screwing the reticle member into such sleeve by a screwdriver inserted into slot 53. It should be noted that the aiming apertures 54 are of a much smaller diameter than the thickness of the light guide 52 and that a common output end 58 of such light guide covers all 3 of the aiming apertures 54A, 54B and 54C shown in FIG. 5. For example, the aiming apertures 54 may have a diameter of 0.018 inch while the light guide 52 has a thickness of 0.130 inch a width of 0.411 inch and a length of 1.5 inch and the reticle slot 53 has a width of 0.135 inch. It should be noted that the light guide 52 is clamped within the slot 53 in the reticle member 22 by the pair of set screws 62 which urge two reticle member projections on opposite sides of the slot together, as shown in FIG. 6.

Figure 4:
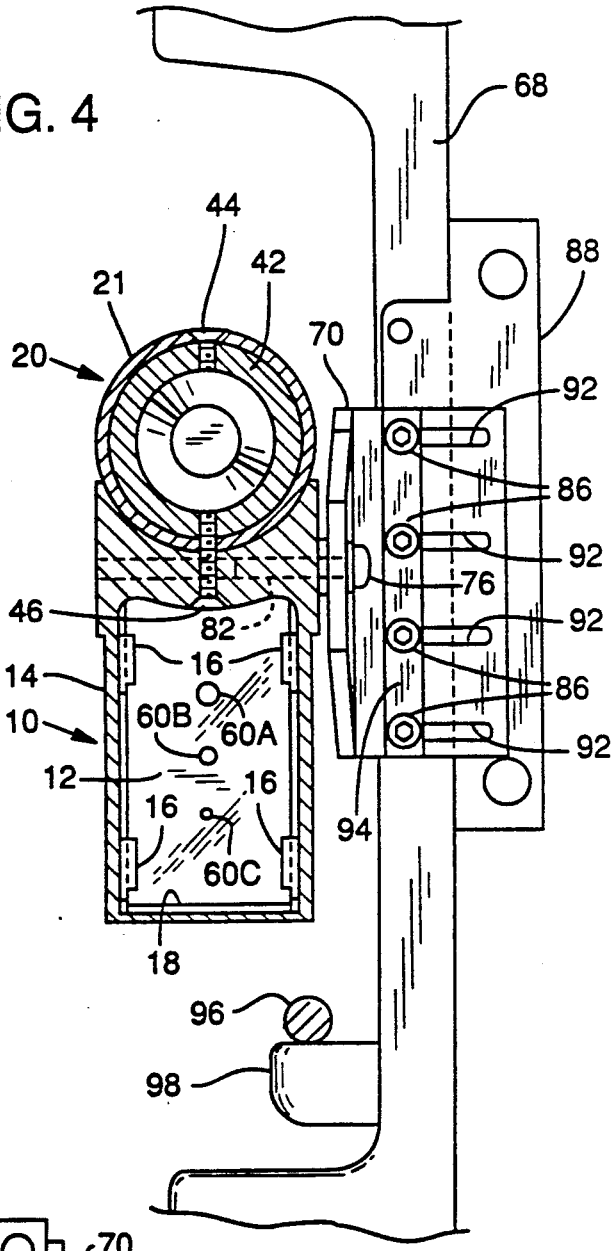
FIG. 4 is a vertical section view taken along the line 4—4 of FIG. 3.
Figure 7:
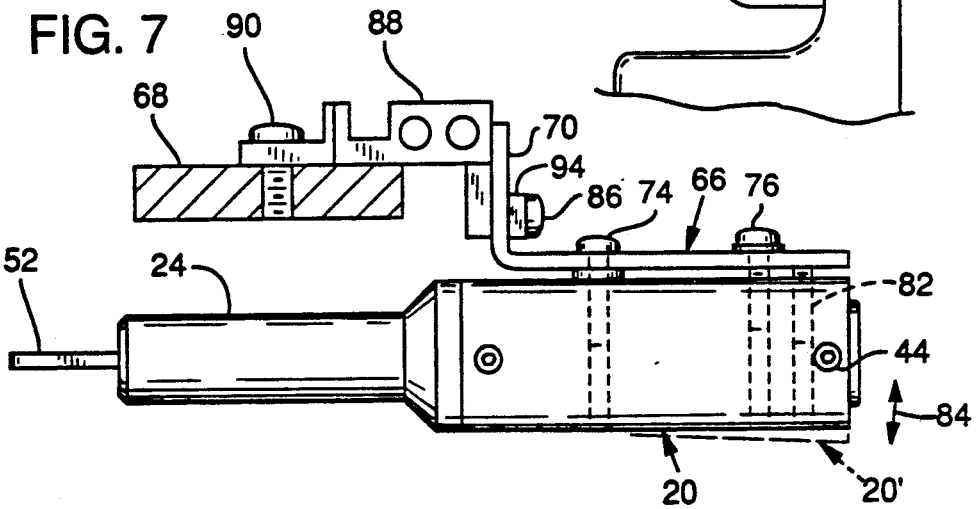
FIG. 7 is a top plan view of the bow sight apparatus of FIGS. 1 and 2 showing a mounting bracket which is adjusted for aiming.

As shown in FIGS. 2, 4 and 7, the bow sight apparatus of the present invention is secured by an adjustable mounting bracket device 66 to the bow handle 68. The mounting bracket 66 includes an L- shaped bracket member 70 having a finger portion 72 surrounded by a U-shaped slot 73 through such bracket member. The finger portion is attached by means of a screw 74 to the side of the viewer housing 14. The main body portion of the L-shaped bracket member 70 is fastened to the housing by an adjustment screw 76 extending through an arcuate slot 78 in such bracket member. As a result, when the adjustment screw 76 is loosened, the mounting bracket 66 may pivot about screw 74 through a limited arc indicated by arrows 80 and determined by the length of the arcuate slot 78. This provides vertical adjustment of the bow sight with respect to the bow. Horizontal adjustment of the bow sight is accomplished by flexing movement of the main body portion of the mounting bracket 70 with respect to the fixed fingered portion 72 which is achieved by tightening the adjustment screw 76 to clamp the bracket member 70 against an adjustable stop screw 82 as shown in FIG. 7. Thus, when the stop screw 82 is screwed further in to cause its upper end to extend out of the housing further, it engages the bracket member farther away from the housing to maintain the sight in an adjusted position 20' when the adjustment screw 76 is tightened to clamp such bracket member between the head of such adjustment screw and the stop screw. This horizontal adjustment of the bracket member 70 and the bow sight apparatus 20 secured thereto is indicated by adjustment arrows 84 in FIG. 7.

The mounting bracket member 70 is fixed by fastening screws 86 to an adaptor member 88 of metal which is secured to the bow handle 68 by screws 90 as shown in FIGS. 2 and 4. It should be noted that the fastening screws 86 extend through a elongated slots 92 in the bracket member 70 which enables horizontal adjustment of the mounting bracket relative to the bow handle. Also, the fastening screws 86 extend through a clamping plate 94 which covers the slotted portion of the L-shaped bracket member 70 for more secure clamping.

As shown in FIGS. 1, 3 and 4, the arrow shaft 96 is supported upon a rest projection 98 extending from the bow handle 68 at a position below the viewer 10. The purpose of adjustment of the mounting bracket 66 in the horizontal direction 84 and the vertical direction 80 is to position the selected aiming spot 60 at a point on the target where the arrow impacts the target for more accurate calibration or "aiming in" of the bow sight.

Figure 8:
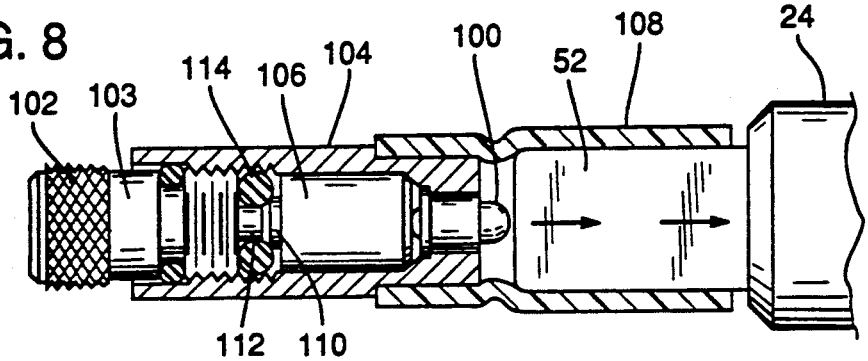
FIG. 8 is an enlarged section view of a modification showing a battery operated auxiliary light source for illuminating the bow sight.

As shown in FIG. 8 an auxiliary battery operated light source may be employed to provide additional light input to the light guide 52. The auxiliary light source may be a light emitting diode 100 which emits green colored visible light of substantially the same wavelength as the fluorescent light emitted by the light guide 52. This auxiliary light is transmitted through the exposed end of the light guide 52 into the guide portion within the sleeve 24 and passes out of such light guide through the output end 58 of the light guide where it is transmitted through the aiming apertures 54A, 54B, and 54C of the reticle 22 as shown in FIG. 6. The light emitting diode 100 is turned on by means of a knurled knob portion 102 on a rotating switch member 103 threadably secured within a light housing 104. The switch member 103 closes one end of the light housing 104 and when rotated to the "on" position its movable switch contact 112 extends into engagement with a terminal 110 on one end of a direct current battery 106 which is mounted within the housing and connected to the terminal contacts of light emitting diode 100. A rubber O-ring 114 is provided between the switch body 103 and the battery and is compressed by the rotation of the switch body to space the switch body from the battery and to prevent its threaded connection to housing 104 from becoming loose. Thus, when the switch member 103 is rotated into an "on" position it moves the contact 112 longitudinally into engagement with the inner terminal 110 of the battery to ground it to the housing 104 through the threads of switch body 103 thereby completing an electrical circuit which energizes such light bulb and causes it to emit green visible light which is transmitted into the output end of the light guide 52. A flexible clear vinyl plastic sleeve 108 is provided about the right end of the light housing 104 and about the exposed end of the light guide 52 in order to mount the auxiliary light source on such light guide and keep them in close light conducting relationship, as shown in FIG. 8.

Figure 10:
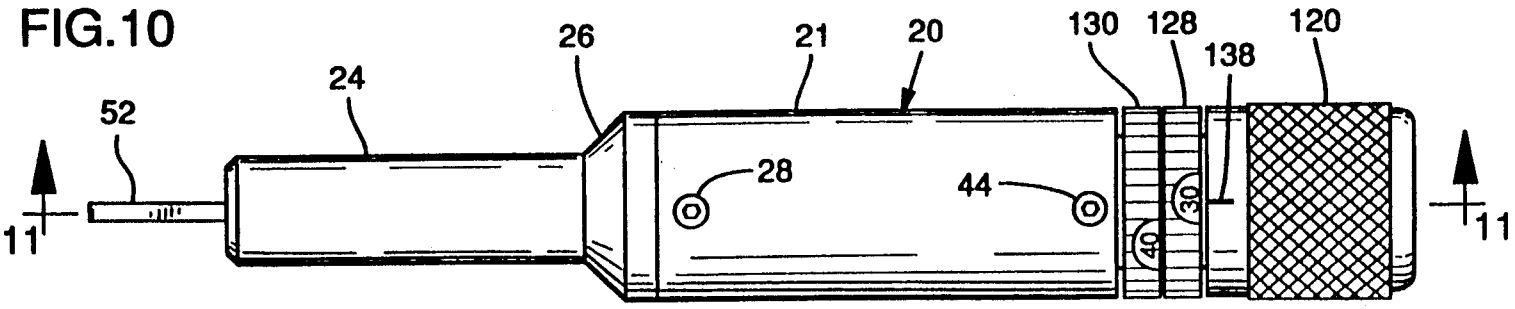
FIG. 10 is a top plan view of the bow sight of FIG. 9.
Figure 9:
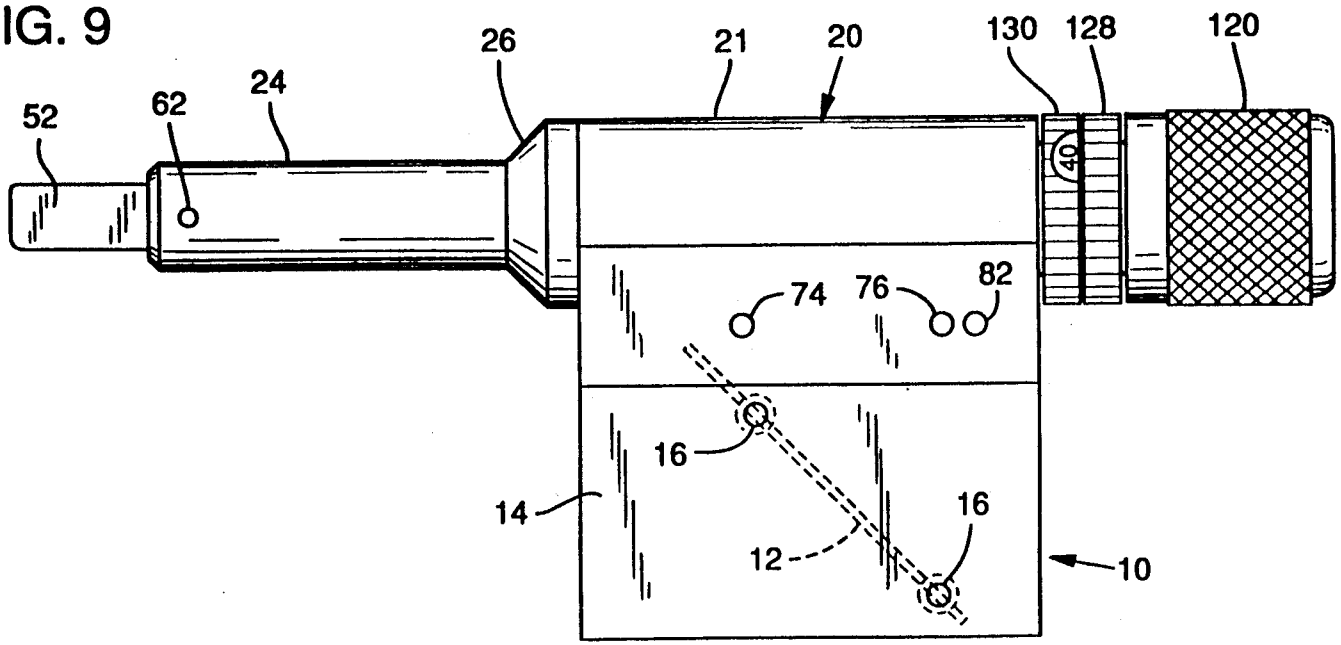
FIG. 9 is a side elevation view of a second embodiment of the bow sight apparatus of the present invention.
Figure 11:
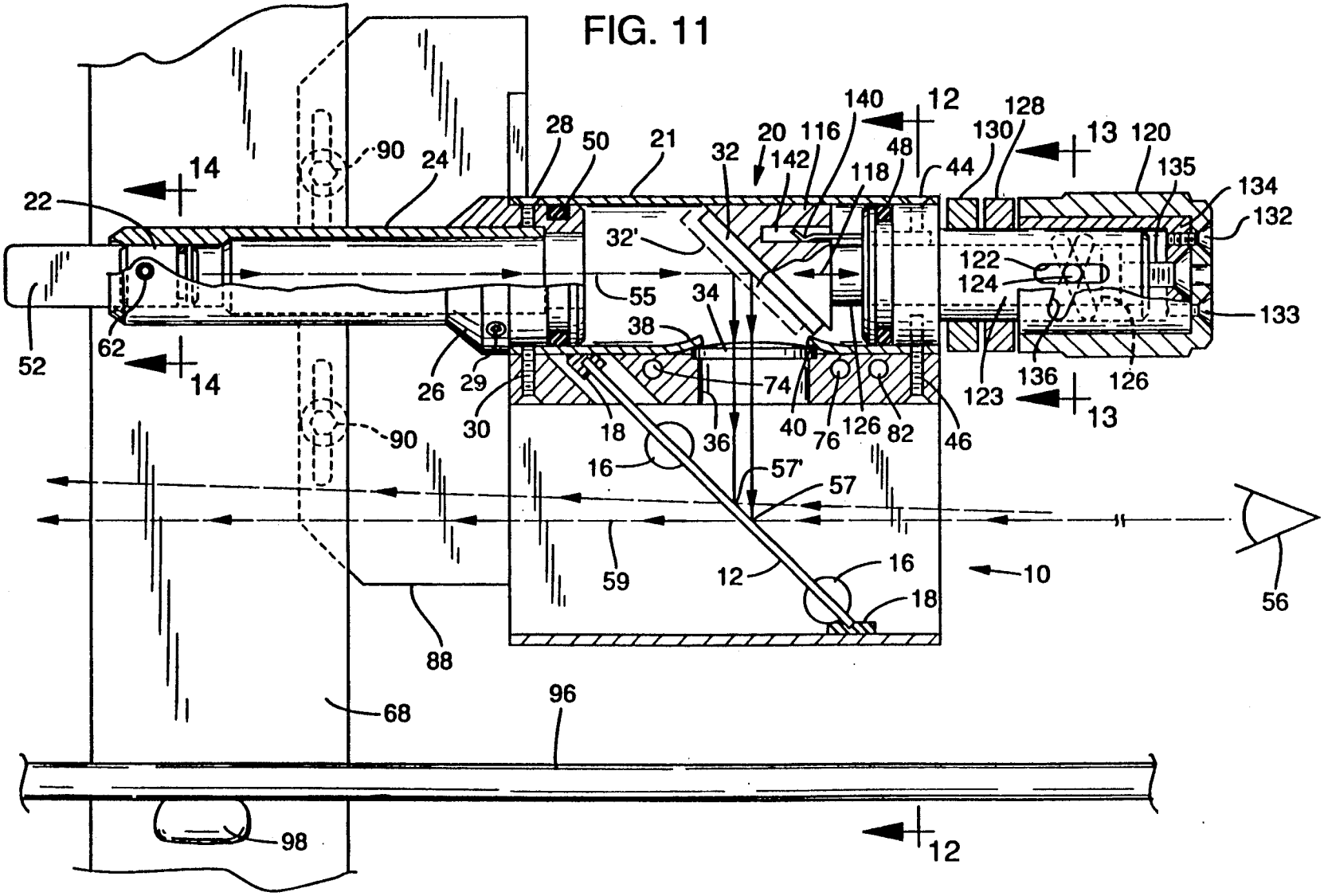
FIG. 11 is an enlarged horizontal section view taken along the lines 11—11 of FIG. 10.

Another embodiment of the bow sight apparatus of the present invention is shown in FIGS. 9, 10 and 11 which is similar to that shown in FIGS. 1, 2 and 3 so that the same reference numerals have been used to designate like parts and only the differences in such second embodiment will be described.

As shown in FIG. 11, the second embodiment of the bow sight differs from that of the first embodiment by employing a movable mirror 32 in the reticle projection system 20. The movable mirror 32 is mounted upon a mirror support 116 which is moved in the longitudinal direction indicated by arrows 118 by rotating a range adjustment knob 120 on the end of the sight. Thus the mirror support 116 is attached to a support shaft 126 which is slideably mounted within a rear adapter member 123 which closes the rear end of housing 21 and is fixed to the housing 21 by screws 44 and 46. The knob 120 is coupled to the mirror support shaft 126 through a guide slot 122 in the rear adapter member 123 by a coupling pin 124 connected to such shaft in a manner hereafter described.

Figure 13:
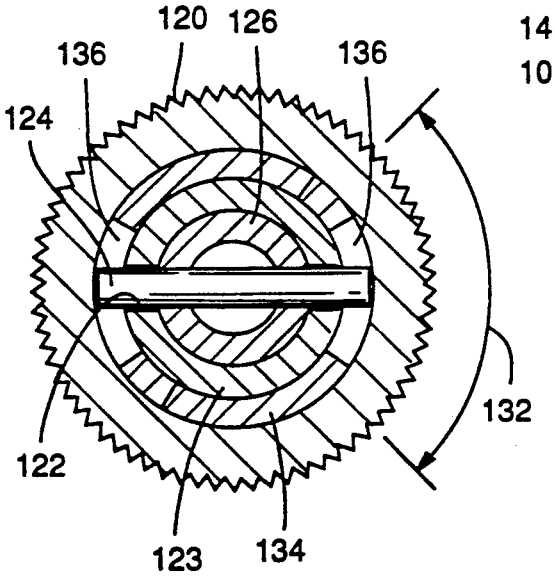
FIG. 13 is a vertical section view taken along the line 13—13 of FIG. 11.

The range adjustment knob 120 is connected by a pair of screws 133 to an adjustment sleeve 134 surrounding the rear adapter 123 end portion which is supported on the adjustment sleeve by a mounting screw 135 extending through an oversized center hole in the end of the sleeve to enable rotation of such sleeve about the rear adapter. The adjustment sleeve 134 is provided with a coupling slot 136 which extends at a diagonal to the axis of the mirror support shaft 126 and is coupled to pin 124 extending through such shaft as shown in FIG. 11. Thus, rotation of the knob 120 causes the sleeve 134 to rotate which moves the pin 124 longitudinally as a result of the rotational movement of the slot 136. This causes the pin 124 to move within the guide slot 122 extending through the adaptor member resulting in a longitudinally movement of the shaft 126 and mirror support 116 in the direction of arrows 118 as shown in FIG. 11. The amount of adjustment of the knob 120 is limited by the opposite ends of coupling slot 136 in the adjustment sleeve 134 which are engaged by the pin 124 to limit the rotation of the knob 120 to an arc 132 of about 90 degrees as indicated in FIG. 13. One end of the arc corresponds to a range of 20 yards and the other end of the arc corresponds to a range of about 50 yards and the mirror movement through such arc results in a range difference of about 30 yards from stop to stop.

Figure 12:
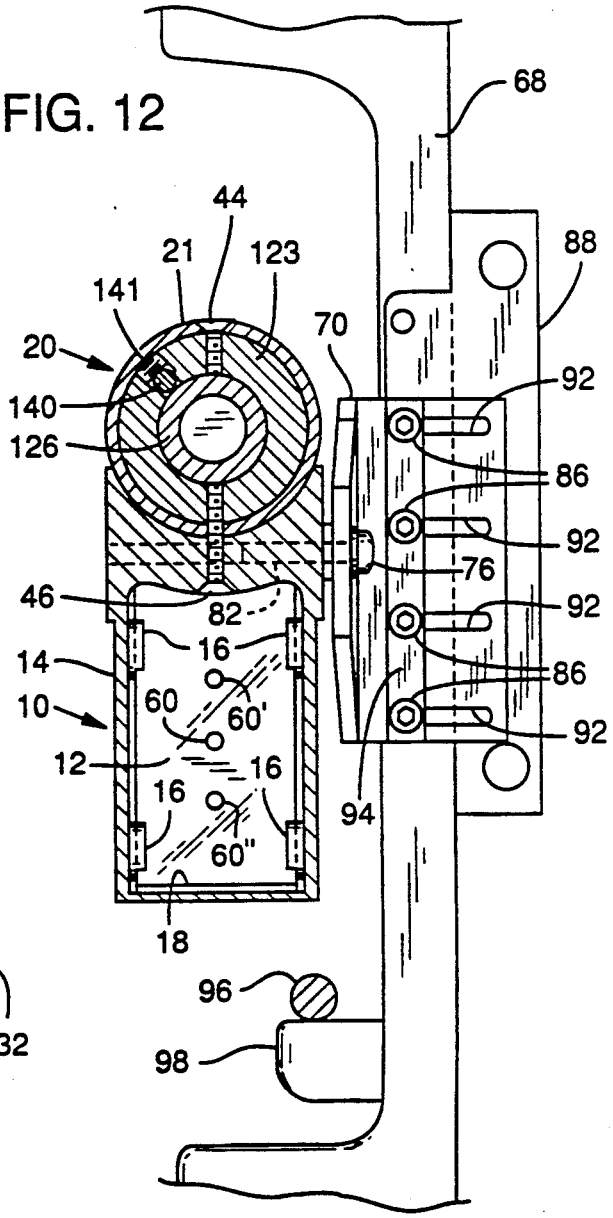
FIG. 12 is a vertical section view taken along the line 12—12 of FIG. 11.
Figure 14:
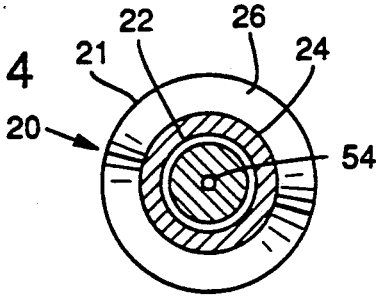
FIG. 14 are vertical section views taken along the line 14—14 of FIG. 11.

Movement of the mirror 32 from the position shown in solid lines forward to the position 32' shown in dashed lines results in upward movement of the position of the aiming spot 60 to position 60' superimposed at point 57' on the target image as shown in FIGS. 11 and 12. Thus a range adjustment of approximately 20 to 50 yards is achieved using a single aiming spot 60 produced by a single aiming aperture 54 in the reticle 22 as shown in FIGS. 12 and 14.

It should be noted that the mirror 32 is shown in FIG. 11 in the middle position of its adjustment range and it may be adjusted forwardly into the forward position 32' corresponding to the higher spot position 60' or rearwardly to a rearward position corresponding to the lower spot position 60'' in FIG. 12. A pair of range indicator discs 128 and 130 are provided around the right end of adapter 123 and positioned between the knob 120 and the housing 21. The range discs 128 and 130 are adjusted to the proper rotational positions on the adapter end shaft and fixed thereto so that the discs and sight are calibrated to indicate the selected range as 30 yards or 40 yards, respectively when aligned with pointer 138 on the adjustment knob 120. For example the sight may be adjusted to a range of 30 yards by aligning the pointer 138 with the 30 yard range indicator as shown in FIG. 10. The range indicator discs 128 and 130 are fixed in position on the adapter 123 by set screws to indicate calibrated ranges of 30 yards and 40 yards respectively which is in within the range of adjustment 132 but does not define the limits of such range. Thus, the range collars are initially adjusted rotationally to line up with the pointer 138 on the knob 120 when the aiming spot 60 coincides with the impact point of the arrow on the target at the 30 yard range and the 40 yard respectively during calibration or "aiming in" of the sight.

As shown in FIGS. 11 and 12, the adaptor member 123 is provided with a spring arm 140 which extends into a passage 142 in the mirror support 116 in order to stabilize such mirror support during its movement. Thus, the spring 140 prevents backlash movement of the mirror shaft.

It will be obvious to those having ordinary skill in the art that many changes may be made in the above-described preferred embodiments without departing from the invention. Therefore, the scope of the invention is to be determined by the following claims.

I claim:

1. A bow sight apparatus, comprising:

viewer means for providing a field of view in which a target can be sighted;

reticle means located outside said field of view for providing an aiming spot of colored light of a predetermined light wavelength range which is superimposed over an image of the target in said field of view, said reticle means including an apertured reticle member having a plurality of aiming apertures therethrough which provide a plurality of spaced, distinguishable aiming spots;

a light guide member for transmitting said colored light through said guide member and said aiming aperture to produce said aiming spot, said guide member having a light output end which covers all of said aiming apertures and is located outside but adjacent to said aiming aperture;

optical imaging means for superimposing said aiming spot over the target image in said field of view, said optical imaging means including a partial reflecting mirror which reflects light of said predetermined wavelength range and transmits light of another wavelength range; and range selection means for selecting different target ranges for targets indicated by different ones of the aiming spots.

2. A bow sight in accordance with claim 1 which also includes reticle mount means for releasably mounting the apertured reticle member within a tubular housing for quick replacement of the reticle member without disassembly of the housing.

3. A bow sight in accordance with claim 1 in which the reticle member includes aiming apertures of different size or different spacing to provide the distinguishable aiming spots.

4. A bow sight in accordance with claim 1 in which the apertured reticle member includes a notch on the surface of one side thereof for receiving the output end of the light guide member in such notch at a position over said aiming aperture.

5. A bow sight in accordance with claim 1 in which the partial reflecting mirror is mounted in a viewer housing within slots provided in a plurality of mounting buttons on opposite side edges of the mirror and between resilient pressure pads at the top and bottom edges of the mirror.

6. A bow sight apparatus, comprising:

viewer means for providing a field of view in which a target can be sighted;

reticle means located outside said field of view for providing an aiming spot of colored light of a predetermined light wavelength range which is superimposed over an image of the target in said field of view, said reticle means including an apertured reticle member having at least one aiming aperture therethrough which provides a corresponding aiming spot, a light guide member for transmitting said colored light through said guide member and said aiming aperture to produce said aiming spot, said guide member having a light output end which is larger than said aiming aperture and is located outside but adjacent to said aiming aperture;

range selection means for selecting different target ranges for targets indicated by the aiming spot; and adjustable bow mount means for mounting said bow sight apparatus to a bow and for adjusting the position of the bow sight on the bow to aim the bow sight, said mount means including bracket means for making vertical and horizontal adjustments of the mounted position of the bow sight to aim the bow sight.

7. A bow sight in accordance with claim 6 in which the bracket means includes a pivot means for vertical adjustment.

8. A bow sight in accordance with claim 7 in which the bracket means is provided with an adjustment slot and a clamp screw is provided on the bow sight to extend through said slot for clamping the bow sight at a selected pivot angle after vertical adjustment about the pivot means.

9. A bow sight in accordance with claim 8 in which the pivot means is provided on a bracket finger portion separated by a U-shaped notch from the main portion of the bracket to enable the finger portion to flex relative to the main bracket portion for horizontal adjustment of the bow sight by clamping the main bracket portion against an adjustable stop on said bow sight.

10. A bow sight apparatus, comprising:

viewer means for providing a field of view in which a target can be sighted;

reticle means located outside said field of view for providing an aiming spot of colored light of a predetermined light wavelength range which is superimposed over an image of the target in said field of view, said reticle means including an apertured reticle member having at least one aiming aperture therethrough which provides a corresponding aiming spot;

a light guide member for transmitting said colored light through said guide member and said aiming aperture to produce said aiming spot, said guide member having a light output end which is larger than said aiming aperture and is located outside but adjacent to said aiming aperture;

optical imaging means for superimposing said aiming spot over the target image in said field of view, said optical imaging means including a partial reflecting mirror which reflects light of said predetermined wavelength range and transmits light of another wavelength range; and the apertured reticle member is mounted in a tube having an open end through which the light guide member extends, said reticle member including locating means for locating the light guide means in position over the aiming aperture in said reticle member.

11. A bow sight in accordance with claim 10 in which said light guide member is made of a fluorescent material which converts ambient light to colored light of said predetermined wavelength range.

12. A bow sight in accordance with claim 11 in which colored light is green.

13. A bow sight in accordance with claim 10 in which the light guide member is coupled to an external artificial light source.

14. A bow sight in accordance with claim 13 in which the external light source includes a battery operated light emitting diode which emits light of said predetermined wavelength.

15. A bow sight apparatus, comprising:

viewer means for providing a field of view in which a target can be sighted;

reticle means located outside said field of view for providing an aiming spot of colored light of a predetermined light wavelength range which is superimposed over an image of the target in said field of view, said reticle means including an apertured reticle member having at least one aiming aperture therethrough which provides a corresponding aiming spot;

a light guide member for transmitting said colored light through said guide member and said aiming aperture to produce said aiming spot;

optical imaging means for superimposing said aiming spot over the target image in said field of view; and adjustable bow mount means for mounting said bow sight apparatus to a bow, including bracket means for making vertical and horizontal adjustments of the mounted position of the bow sight to aim the bow sight.

16. A bow sight in accordance with claim 15 in which the bracket means includes a pivot means for vertical adjustment.

17. A bow sight in accordance with claim 16 in which the bracket means is provided with an adjustment slot and a clamp screw is provided on the bow sight to extend through said slot for clamping the bow sight at a selected pivot angle after vertical adjustment about the pivot means.

18. A bow sight in accordance with claim 17 in which the pivot means is provided on a bracket finger portion separated by a U-shaped notch from the main portion of the bracket to enable the finger portion to flex relative to the main bracket position for horizontal adjustment of the bow sight by clamping the main bracket portion against an adjustable stop on said bow sight.

* * * * *